US005803321A

United States Patent [19]

Willinger et al.

[11] Patent Number: 5,803,321

[45] Date of Patent: Sep. 8, 1998

[54] HANGER WITH GANGING ELEMENT

[75] Inventors: Jonathan Willinger, Englewood; Robert N. Shaw, Piscataway, both of N.J.

[73] Assignee: Randy Hangers, LLL, Englewood, N.J.

[21] Appl. No.: 747,458

[22] Filed: Nov. 12, 1996

[51] Int. Cl.[6] ..... A47G 25/18; A47G 25/14

[52] U.S. Cl. ..... 223/88; 223/85; 248/317; 248/339

[58] Field of Search ..... 223/85, 88, DIG. 3, 223/DIG. 4; 248/339, 317; 211/118

[56] References Cited

U.S. PATENT DOCUMENTS

| | | | |
|---|---|---|---|
| 3,378,180 | 4/1968 | Singer | 223/88 |
| 3,952,985 | 4/1976 | Davenport | 248/317 |
| 4,284,219 | 8/1981 | Standel, Jr. | 248/317 |
| 4,416,401 | 11/1983 | King . | |
| 4,653,678 | 3/1987 | Blanchard et al. . | |
| 4,871,098 | 10/1989 | Bredeweg et al. . | |
| 5,029,739 | 7/1991 | Blan hard et al. . | |
| 5,074,445 | 12/1991 | Chen . | |
| 5,330,244 | 7/1994 | Rodwell | 223/DIG. 4 |
| 5,499,789 | 3/1996 | Rose | 248/317 |

*Primary Examiner*—Bibhu Mohanty
*Attorney, Agent, or Firm*—Helfgott & Karas, P.C.

[57] ABSTRACT

A garment hanger having a hanger body and a hook member is constructed with a hook receiving element for suspending from the body of the garment hanger a second garment hanger. The hook receiving element is disposed in vertical alignment with the hook member and includes a frame member and base member, the frame member is provided with openings to define first and second intersecting passageways for selectively receiving the hanging means of the second garment hanger. In this manner the second garment hanger may be suspended in a plane parallel to the plane of the hanger body or perpendicular thereto.

14 Claims, 3 Drawing Sheets

HANGER WITH GANGING ELEMENT

BACKGROUND OF THE INVENTION

1. Field of the Invention

The present invention relates in general to a garment hanger adapted for hanging therefrom at least one additional hanger, and, in particular, to a garment hanger having a hook receiving element depending therefrom for defining first and second intersecting passageways for selectively receiving and suspending a hanging means of a second garment hanger.

2. Description of Prior Developments

It can be appreciated that many garments are designed to be worn and sold as outfits or sets. For example, a jacket and pant set, a jacket and top set, a short and top set or other such combinations may be specifically manufactured to be sold as sets. In the sale of such garment sets, it is therefore desirable to display these garments together to convey to the consumer that the garments are indeed a set to be purchased together. To that end the separate garments may be hung on separate hangers and displayed alongside or next to each other, or the garments may be hung on a single hanger. The drawbacks in such display methods are obvious in that in the first example some frame or support is required to display the garments together and in the second example sharing a hanger may obscure one of the individual garments that make up a garment set.

It can also be appreciated that a further benefit in displaying such garment sets together, or in displaying garments of a similar style and color together, is that the amount of display space needed can be significantly reduced. A still further benefit of displaying such items together would be to make it easier for the consumer to find and purchase such garments. This economy of space and ease of organization may obviously also extend to the transport and storage of such garments.

To address these needs hangers have been made available with a loop joined to the hanger body for hanging therefrom a second garment hanger. For example, U.S. Pat. No. 4,871,098 discloses a hanger having a loop mounted to an underside of the body of the first garment hanger for suspending a second garment hanger. While such hangers have performed satisfactorily and have to an extent made it possible to display and transport certain garment together, such hangers have only allowed a second hanger to be suspended in a plane parallel to the plane of the first garment hanger. Additionally such hangers have not provided a loop which would allow for selectively suspending hangers having hanging means of varying size.

Furthermore, such loops have been provided with a narrow base member that has resulted in the hanging means of a second garment hanger unnecessarily rocking freely about such base member.

A need therefor continues to exist for a garment hanger having a means for firmly supporting at least a second garment hanger for displaying, storing and transporting garments.

A further need exists for such a garment hanger which permits a second garment hanger to be suspended securely with little rocking motion of the hanger.

A still further need exists for a garment hanger having a hook receiving element or loop that would permit selectively suspending therefrom the hanging means of a second garment hanger in either a direction parallel to the plane of the first garment hanger or perpendicular thereto.

SUMMARY OF THE INVENTION

The present invention has been developed to fulfill the needs noted above and therefore has as an object the provision of a garment hanger having a hook receiving element which may be used to suspend therefrom a second garment hanger for displaying or transporting garments.

Another object of the invention is to provide a garment hanger including a hook receiving element having a support or base member adapted to securely suspend a second garment hanger in a plane either substantially parallel to the plane of the first garment hanger or in a plane substantially perpendicular thereto.

Still another object of the invention is to provide a garment hanger having a hook receiving element depending from said hanger which is provided with openings for easily receiving a hanging means of a second garment hanger.

Yet another object of this invention is to provide a garment hanger particularly adapted to allow omidirectional mounting of a second garment hanger thereto by providing a hook receiving member defining first and second intersecting passageways for receiving the hanging means of a second garment hanger.

These and other objects are met by a garment hanger including a hanger body and a hook member joined thereto. For supporting a second garment hanger, the hanger body has been provided with a hook receiving element joined to a lower end thereof. The hook receiving element is preferably mounted to the hanger body at a point below and in vertical alignment with the hook member for maintaining said first and second garment hangers in balance when in use. The hook receiving element including a frame member and a base or support member joined to the frame member at a distal end thereof for defining first and second intersecting passageways. The frame member being provided with a face member depending from a front side of the hanger body and a rear member depending from a rear side of the hanger body; the face and rear members each terminating in the base or supporting member and separated in a direction normal to the plane of the hanger body by the length of the base or supporting member to define the first passageway therebetween. The face frame and the rear frame each being provided with a hook receiving opening in alignment for defining the second passageway.

By providing first and second intersecting passageways, a second garment hanger may be selectively suspended from said first garment hanger in a direction substantially parallel to the plane of the first garment hanger or alternatively substantially perpendicular thereto.

The aforementioned objects features and advantages of the invention will be pointed out with particularity and will in part become obvious from the following more detailed description of the invention taken in conjunction with the accompanying drawings which form and integral part thereof.

DETAILED DESCRIPTION OF THE PREFERRED EMBODIMENTS

Figure 1:
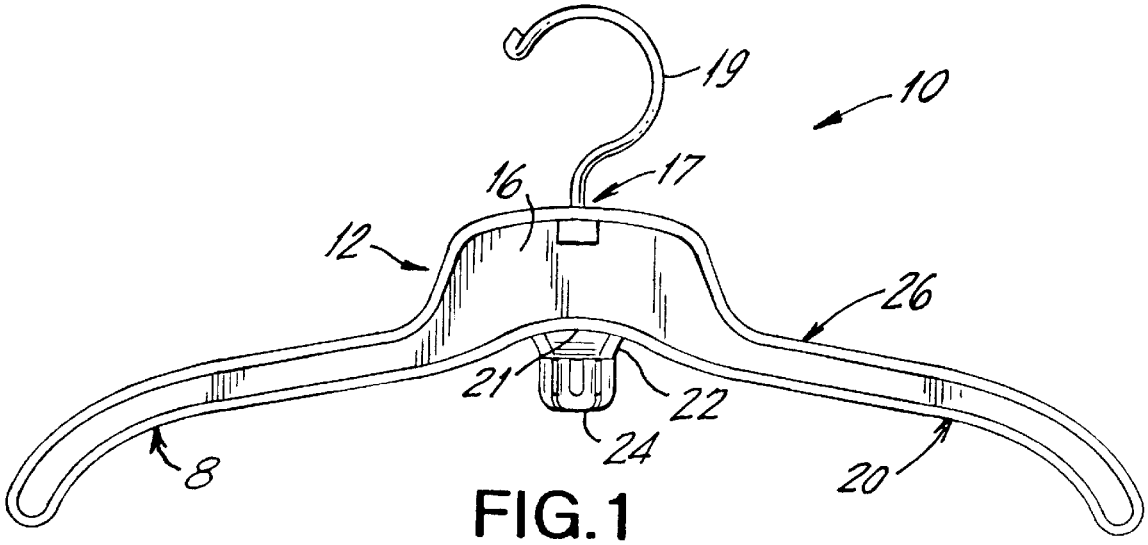
FIG. 1 is a front elevation view of a first embodiment of the garment hanger of the present invention.

The present invention will now be described in conjunction with the drawings beginning with FIG. 1 which generally depicts a molded garment hanger 10 constructed in accordance with the present invention. Hanger 10 includes a hanger body 12 having a body member 16 and a pair of downwardly sloping arms 18 and 20 extending therefrom.

The body member 16 includes an upper end 17 to which is rotatably mounted a metal hook member 19 for suspending garment hanger 10. Alternatively hook member 19 may be of a suitable polymer molded integral with body member 16. Mounted adjacent a lower curved end 21 of body portion 16 is an abutment 22 from which depends a hook receiving element 24 for suspending therefrom a second garment hanger.

While the description herein will focus on a molded garment hanger, the present invention could be adapted for use on a wood based hanger body being equipped with a metal hook member.

It should also be appreciated that the specific embodiment of the garment hanger described herein is merely for the purpose of illustration and that the hook receiving element of the present invention may be mounted to any number of polymer based molded garment hangers in use today.

Details of an embodiment of hanger 10 including a hook receiving element 24 are shown in FIGS. 2–5 wherein hanger body 12 is provided with an enlarged peripheral flange or lip 26 extending entirely about an outermost edge of hanger body 12. The flange 26 has a width generally greater than a width of hanger body 12 as measured between a leading or front edge 28 forward of and normal to hanger body 12 and a rear or trailing edge 30 rearward of and normal to hanger body 12. The provision of peripheral flange 26 has as a benefit other than the obvious benefit of reinforcing the construction of garment hanger 10, the provision of an enlarged surface to which abutment 22 or hook receiving element 24 may be integrally molded or otherwise joined.

Figure 2:
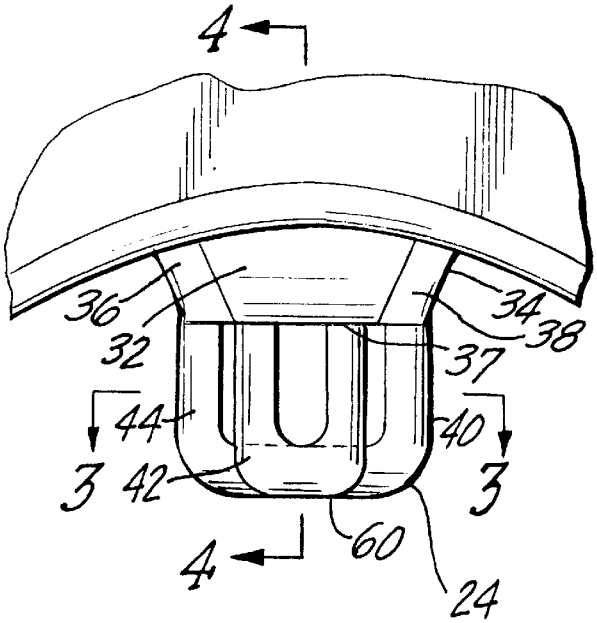
FIG. 2 is an enlarged fragmentary front elevation view of a first embodiment of the garment hanger of the present invention.

As shown in FIG. 2, boss or abutment 22 may be solidly constructed of a suitable polymer material of a type used in the construction of hanger body 12 and includes a generally trapezoidal front wall 32 and a larger generally trapezoidal rear wall 34. Front wall 32 and rear wall 34 extend downwardly from flange 26 and are preferably substantially flush with front edge 28 and rear edge 30, respectively.

In this manner abutment 22 may be configured to maximize the area available for integrally or otherwise joining thereto hook receiving element 24. Abutment 22 further includes a pair of sidewalls 36 and 38 which join front wall 32 to rear wall 34. As front wall 32 is generally smaller than rear wall 34 sidewalls 36 and 38 slope outwardly from front wall 32 toward rear wall 34.

Abutment 22 is further provided with a substantially flat end wall 37 for mounting securely thereto hook receiving element 24. It should be noted that alternatively abutment 22 may be omitted and that hook receiving element 24 may be joined directly to flange 26. In this regard, hook receiving element 24 may be integrally molded to flange 26 or joined thereto as by means of heat welding.

The hook receiving element 24 which is the subject of this invention is disposed below body member 16 and joined to flat end wall 37 preferably in vertical alignment with hook member 19. As is best seen in FIGS. 2–4 hook receiving element 24 has a generally trapezoidal cross section and includes a frame member 40 depending from end wall 37 and a base or supporting member 39 joined to frame member 40 at a distal end thereof.

Figure 3:
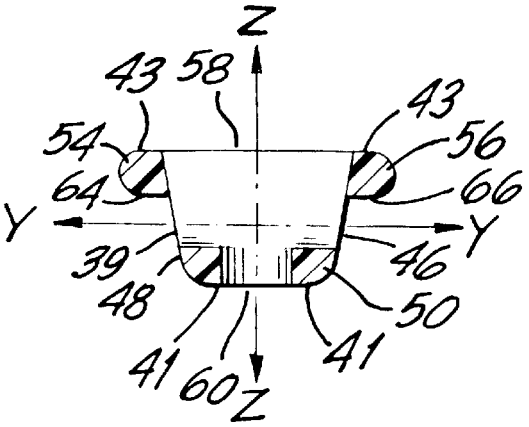
FIG. 3 is a partial view in section taken along the section line 3—3 of FIG. 2.
Figure 4:
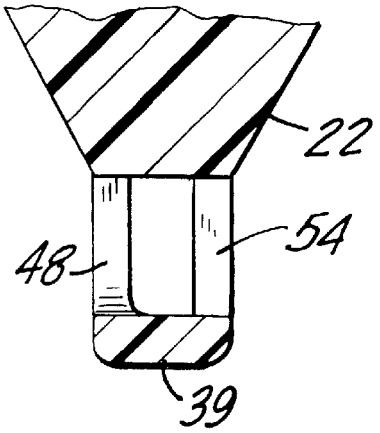
FIG. 4 is an enlarged partial view in section taken along the section line 4—4 of FIG. 2.

As shown in FIG. 3, base member 39 is preferably a generally planar wall extending substantially perpendicular to frame member 40 for suspending a hanging means of a second garment hanger. Although base member 39 has been depicted as a generally planar wall, base member 39 may be provided with recesses or grooves for seating therein a hanging means. Alternatively base member 39 may be provided with an opening or cutout. In such an embodiment, not shown, base member 39 would have the general appearance of a trapezoidal frame with only oppositely disposed frame members being used to support a hanging means of a second garment hanger. As will become apparent the shape and dimension of base member 39 is determined largely by the particular configuration adopted for frame member 40.

The frame member 40 includes a face or front member 42 and a rear or back member 44 each joined to base member 39 at opposite ends thereof. In this manner face member 42 and rear member 44 are spaced apart along an axis normal to the vertical plane of frame member 40 to define a first bilateral passageway or channel 46 for receiving a hanging means of second garment hanger.

In joining frame member 40 to abutment 22, face member 42 is preferably substantially flush with front wall 32 and rear member 44 is preferably substantially flush with rear wall 34. In this manner the first bilateral passageway or channel 46 of frame member 40 is more apt to accommodate hanging means of varying width and size.

As seen in FIGS. 2 and 4, face member 42 includes a pair of depending legs 48 and 50 each leg independently joined to base wall 39 and spaced apart lengthwise of hanger 10 to frame or define a first vertically elongated hook receiving opening 52. Similarly back member 44 includes a pair of depending legs 54 and 56 each leg independently joined to base wall 39 and spaced apart lengthwise of hanger 10 to define a second vertically hook receiving opening 58.

The first hook receiving opening 52 and second hook receiving opening 58 are substantially aligned along an axis normal to the frame member 40 and define or frame a second bilateral passageway or channel 60 for receiving a hanging means in a direction substantially normal to the plane of hanger body 16.

The first bilateral passageway 46 and second bilateral passageway 60 may intersect orthogonally at a point below hanger body 16 in vertical alignment with hook member 19 to form a substantially box-like internal chamber 62 housed within frame member 40 and through which a hanging means of a second garment hanger must pass.

As rear member 44 is generally larger than face member 42 and the lengthwise spacing of depending legs 54 and 56 is greater than that of depending legs 48 and 50, when viewing hook receiving element 24 in a direction normal thereto, it can be seen that depending leg 54 extends laterally beyond an outermost edge of depending legs 48 and that depending legs 56 extends laterally beyond an outermost edge of depending leg 50. The laterally extending portions and the generally larger rear member 44 act as shoulders for resting or supporting a hanging means of a second hanger, but are otherwise a non-functional aspect of hook receiving element 24 necessitated in part by constraints in the molding process.

While an embodiment has been shown depicting the lateral width of face member 42 being less than that of rear member 44 it should be apparent that the lateral width of rear member 44 may be less than that of face member 42. In such an embodiment the hook receiving means 24 and abutment 22 have been effectively rotated 180 degrees.

Figure 5:
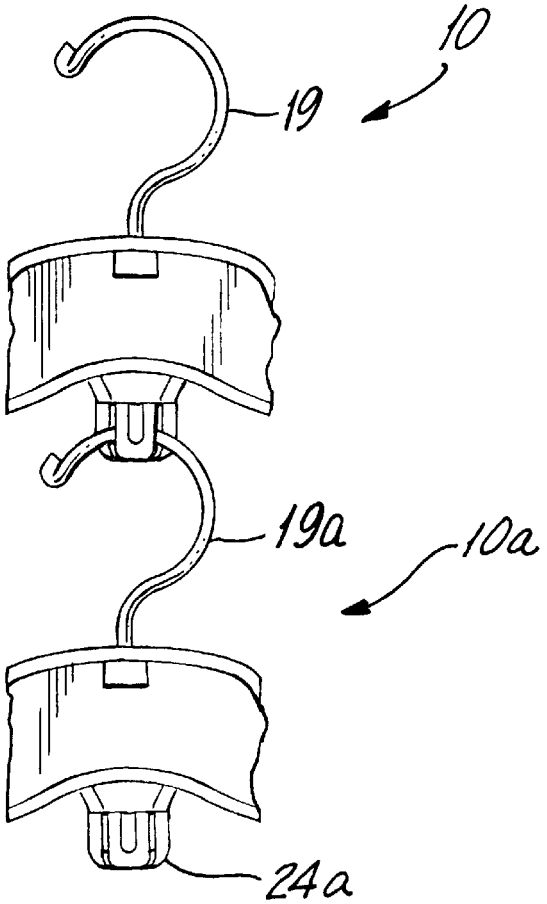
FIG. 5 is a fragmentary front elevation view depicting a second hanger suspending from a first hanger utilizing the present invention.

As shown in FIG. 5, to suspend hook member 19*a* of second garment hanger 10*a*, hook member 19*a* may be inserted in first bilateral passageway 46 along axis Y—Y either from left to right or vice versa. Once inserted hook member 19*a* is suspended by base or supporting member 39 and second garment hanger 10*a* is disposed in a plane generally parallel to the plane of garment hanger 10.

Alternatively, hook member 19*a* may be inserted in second bilateral passageway 60 along axis Z—Z from front to rear or vice versa, not shown. Once inserted hook member 19*a* is suspended by base member 39 and second garment hanger 10*a* is disposed in a plane generally perpendicular to the plane of garment hanger 10. Although FIG. 5, depicts only two garment hangers suspended in accordance with the present invention, it should be appreciated that if the ganged or suspended garment hangers garment hangers similarly are provided with a hook receiving element of the present invention that a seemingly endless number of hangers may be ganged or suspended.

Figure 6:
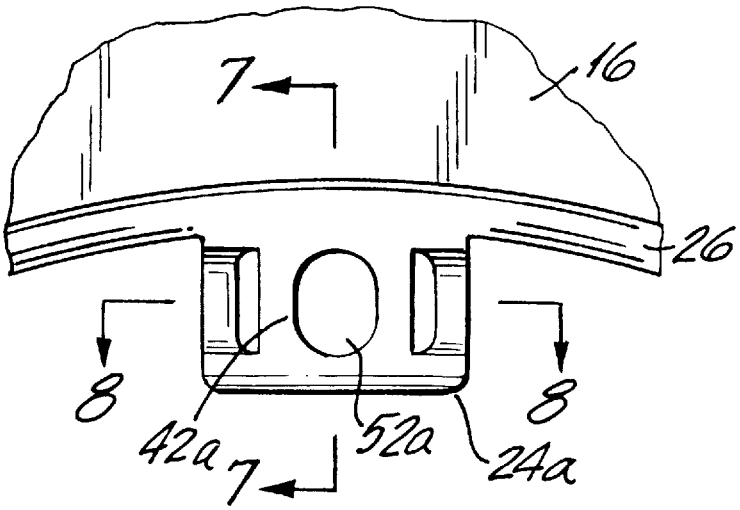
FIG. 6 is an enlarged fragmentary front elevation view of another embodiment of the garment hanger of the present invention.
Figure 7:
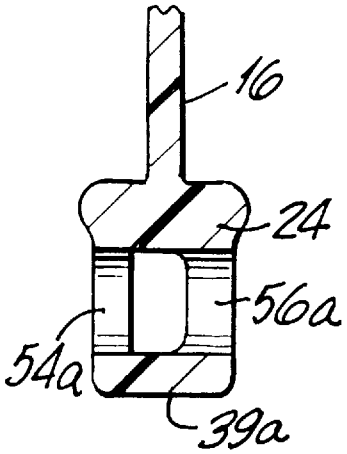
FIG. 7 is a partial view in section taken along the section line 7—7 of FIG. 6.
Figure 8:
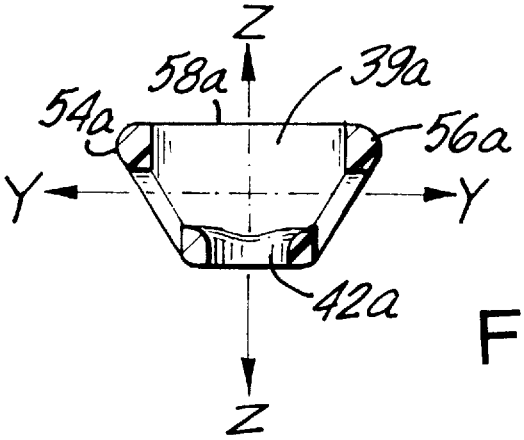
FIG. 8 is an enlarged partial view in section taken along the section line 8—8 of FIG. 6.

Referring now to FIGS. 6–8, another embodiment of a hook receiving element 24*a* will be described. Like reference numbers are used in FIGS. 6–8 to denote elements similar to those of the first disclosed embodiment.

FIGS. 6–8 depicts a hook receiving element 24*a* having a construction substantially similar to that of hook receiving element 24. While the dimensions of hook receiving element 24*a* are somewhat different than the first embodiment, its function and design remain substantially unchanged. Accordingly, a detailed description of such differences will not be given. It should be apparent that many other minor design changes may be accomplished that would not depart from the spirit of the invention.

As shown in FIG. 6, an abutment 22 has not been used to join hook receiving element 24*a* to hanger body 12. Rather hook receiving element 24*a* has been integrally joined to flange 26 between leading edge 28 and rear edge 30. Hook receiving element 24*a* includes face member 42*a* and a rear member 44*a* spaced apart as in the previous embodiment to define a first bilateral passageway or channel 46*a*.

As an alternative to a face member 42 having a pair of depending legs 48 and 50, face member 42*a* has been provided with a generally oval shaped first hook receiving opening 52*a*. The rear member 44*a* includes a pair of depending legs 54*a* and 56*a* for defining a second hook receiving opening 58*a*.

As in the previous embodiment, hook receiving opening 52*a* and second hook receiving opening 58*a* are substantially aligned along an axis normal to the frame member 40*a* to define a second bilateral passageway or channel 60*a*. In this embodiment face member 42*a* is significantly smaller than rear member 44*a*, resulting in second hook receiving opening 58*a* being much larger than first hook receiving opening 52*a*.

As further seen in FIG. 8, face member 42*a* and depending legs 54*a* and 56*a* may be generally flush with base member 39*a*. The base member 39*a* is a generally trapezoidal shaped planar wall for suspending a hanging means of a second garment hanger. The present embodiment of hook receiving element 24*a* joined to first garment hanger permits a second garment hanger to be suspended from hook receiving element 24*a* either in a direction substantially parallel to the plane of the first garment hanger or substantially perpendicular thereto.

There has been disclosed heretofore the best embodiment of the invention presently contemplated. However it is to be understood that various changes and modifications may be made thereto without departing from the spirit of the invention.

What is claimed is:

1. A garment hanger comprising:

a hanger body having a hook member joined to said hanger body at an upper end thereof, and a hook receiving element joined to said body at a lower end thereof;

said hook receiving element including a frame member depending from said hanger body and a base member joined to said frame member at a distal end thereof for defining intersecting first and second passageways for selectively receiving and suspending from said base member a hook member of a second garment hanger;

said frame member having a face member depending from a front side of said hanger body terminating in said base member and a back member depending from a rear side of said hanger body terminating in said base member at an opposite end thereof, said face member and back member being spaced apart along an axis normal to the plane of said hanger body for defining said first passageway therebetween;

said face member having a first opening and said rear member having a second opening for defining said second passageway.

2. The garment hanger of claim 1 further comprising an abutment depending from said lower end of said hanger body for mounting thereto said hook receiving member.

3. The garment hanger of claim 1 wherein said first passageway and said second passageway intersect at a point substantially in vertical alignment with said hook member and define an internal chamber through which said hook member of said second garment hanger may be passed.

4. The garment hanger of claim 1 wherein said first opening has an oval shape for receiving said hook member of said second garment hanger.

5. The garment hanger of claim 1 wherein said rear member comprises a pair of legs each of said legs being spaced apart lengthwise of said hanger and independently joined to said base wall for framing said second opening.

6. The garment hanger of claim 1 wherein said first opening is smaller than said second opening.

7. The garment hanger of claim 6 wherein said first opening and said second opening are axially aligned for further defining said second passageway.

8. A garment hanger comprising:

a hanger body having a hook member joined to said hanger body at an upper end thereof, and a flange mounted about an outermost edge of said hanger body;

a hook receiving element joined to said flange adjacent a lower end of said hanger body, said hook receiving member including a face member and rear member depending from said hanger body and a base member integrally joined to said face member and rear member at distal ends thereof;

said face member and rear member spaced apart normal to said hanger body for defining a first passageway for suspending from said base member a hook member of a second garment hanger in a direction substantially parallel to said hanger body;

said face member having a first opening and said rear member having a second opening substantially in axial alignment for defining a second passageway for alternatively suspending from said base member said hook member of said second garment hanger in a direction substantially perpendicular to said hanger body.

9. The garment hanger of claim 1 wherein said face member further comprises a pair of legs, each of said legs spaced apart lengthwise of said hanger body and independently joined to said base member for framing said first opening.

10. The garment hanger of claim 8 wherein said hook receiving member is substantially in vertical alignment with said hook member.

11. The garment hanger of claim 8 wherein said face member is substantially flush with a leading edge of said flange.

12. The garment hanger of claim 8 wherein said rear member is substantially flush with a rear edge of said flange.

13. The garment hanger of claim 8 wherein said first passageway and said second passageway intersect orthogonally.

14. The garment hanger of claim 8 wherein said base member is substantially flat and normal to said face and rear member.

* * * * *